US005846125A

United States Patent [19]

Robichon

[11] Patent Number: 5,846,125

[45] Date of Patent: Dec. 8, 1998

[54] TRUING WHEEL WITH INCORPORATED COOLING

[75] Inventor: Henri Jean Denis Robichon, Pontosie, France

[73] Assignee: Societe Nationale D'Etude et de Construction de Moteurs d'Aviation "Snecma", Paris, France

[21] Appl. No.: 911,043

[22] Filed: Aug. 14, 1997

[30] Foreign Application Priority Data

Aug. 29, 1996 [FR] France ..... 96 10553

[51] Int. Cl.[6] ..... B24B 55/02

[52] U.S. Cl. ..... 451/450; 451/550; 125/13.01; 125/11.2

[58] Field of Search ..... 451/550, 549, 451/450, 541, 542, 547; 408/57, 59; 407/11; 125/12, 13.01, 18, 11.22; 83/170, 171, 168, 169

[56] References Cited

U.S. PATENT DOCUMENTS

| | | | |
|---|---|---|---|
| 2,776,527 | 1/1957 | Hoyet et al. | 451/550 |
| 2,820,334 | 1/1958 | Touvay | 451/550 |
| 3,517,462 | 6/1970 | Imhof | 451/549 |
| 5,076,024 | 12/1991 | Akagawa et al. | 451/550 |
| 5,423,717 | 6/1995 | Boaz . | |
| 5,582,540 | 12/1996 | Su et al. | 451/550 |
| 5,660,582 | 8/1997 | Terris | 451/549 |
| 5,681,216 | 10/1997 | Jennings | 451/550 |

FOREIGN PATENT DOCUMENTS

| | | |
|---|---|---|
| 0 483 561 | 5/1992 | European Pat. Off. . |
| 0 505 615 | 9/1992 | European Pat. Off. . |
| 500 485 | 6/1930 | Germany . |
| 38 04 781 | 6/1989 | Germany . |

*Primary Examiner*—David A. Scherbel
*Assistant Examiner*—Derris H. Banks
*Attorney, Agent, or Firm*—Oblon, Spivak, McClelland, Maier & Neustadt, P.C.

[57] ABSTRACT

The grinding wheel has its cooling fluid supply system through its own body (1). It has central bores (4) that each open into a side chamber (2) and distribution holes (3) opening out into grooves (11) made in the abrasive deposit (10), preferably alternately inclined. Application to truing wheels made in cubic boron nitride.

6 Claims, 1 Drawing Sheet

TRUING WHEEL WITH INCORPORATED COOLING

FIELD OF THE INVENTION

The invention relates to truing wheels used for the purpose of machining components, generally metal components, with the aim of producing components to very precise sizes and dimensions. In particular, it relates to high speed grinding and more especially grinding by means of cubic boron nitride grinding wheels, called "CBN wheels".

FIELD OF THE INVENTION AND THE PROBLEM POSED

Abrasive grinding wheels are used in grinding to carry out the final finishing operations, with the aim of bringing the surfaces to be machined to a very precise dimension and to a surface condition of optimum quality. The machining surface of the grinding wheel is made up of a multitude of abrasive grains stuck on and agglomerated by a bonding material. The machining surface is set into rotation and the grains machine the surface little by little. The movements of the grinding wheel and the shape of the surface determine the shape and the quality of the final machined surface.

A specific type of grinding wheels, commonly called CBN wheels, is known which consists of grinding wheels where the abrasive material is cubic boron nitride, that is to say a "superabrasive" material, in comparison to the more traditional or conventional aluminous abrasives or silicon carbides. Taking account of the high price of this cubic boron nitride abrasive (of the order of ten thousand times that of a traditional abrasive), a grinding wheel using this type of abrasive does not contain grains of this type in its entire mass, but is generally made up of two parts, which are a mount or central support around which an abrasive layer is positioned that is commonly called a "band". This band is the active part of the grinding wheel and is not generally permeable, that is to say that there are no pores in this part. One may add that the mount can be made of light alloy (AG5) or a mixture of aluminium and resin powders, commonly called "resaloy", or a heavy alloy, for example bronze or steel or a vitrified material.

It should be made clear that cubic boron nitride grinding wheels are used for grinding work on items made of steel or an alloy whose surface hardness is considerably above the average and in sharpening operations on tools made of highly alloyed high speed steel or highly carburated steel. Furthermore, grinding wheels of this type are used at very high rotation speeds, of the order of 15000 to 30000 rpm.

In most grinding operations, it is necessary to thoroughly cool the machining. This allows the heat produced in the grinding work to be taken away in order to partially protect the grinding wheel and the component from damage linked to too high an increase in temperature, to clean the surface of the grinding wheel, to slow down the phenomenon of clogging up by carrying away the cuttings produced far from the area of work, to possibly act as an anti-rusting agent and to serve as a lubricant by modifying the coefficient of friction between the grinding wheel and the component.

To avoid the use of pipes or nozzles emerging in the neighbourhood of the machining point of the grinding wheel, preferably between the grinding wheel and the surface to be machined, and to avoid the use of extra equipment to fix the pipe or cooling nozzle onto the machine, grinding wheels are used with incorporated cooling.

German patent document DE-A-38 04781 describes, in its FIG. 3, a cubic boron nitride grinding wheel, whose abrasive profile is tapered, fitted with a circuit for cooling the abrasive surface of the wheel that ends up with several channels on this surface. External ribs are to be found there, made in the abrasive deposit and inclined just as the supply holes emerging at the surface of the deposit are in an inclined manner. The circuit includes radial holes that supply the abrasive surface with cooling liquid. However the production of these holes is a problem since it requires delicate machining. Furthermore, the uniformity of distribution of the liquid over the whole width of the abrasive surface is not ensured.

The aim of the invention is to remedy these disadvantages.

SUMMARY OF THE INVENTION

To this effect, the main objective of the invention is a truing wheel made up of:

- a body in the form of a disc defining a central axis;
- an abrasive deposit stuck to the peripheral surface of the body (1);
- a cooling fluid supply circuit inside the body that opens into the abrasive deposit by means of several distribution holes that each open into a lateral annular chamber and into the abrasive deposit in order to lubricate the cutting area and cool the wheel,
- characterised in that the cooling fluid supply circuit includes:
  - two lateral annular chambers;
  - at least two central holes from the centre of the wheel that each lead into a lateral annular chamber;
  - several distribution holes from each of the lateral annular chambers that open into the abrasive deposit; and
  - two sealing covers that cover the lateral annular chambers.

Preferably, the distribution holes each open into an external rib made in the abrasive deposit, for example in an inclined manner.

In this case, the ribs are preferably inclined with respect to the central axis of the grinding wheel, the inclination of the rib preferably being alternate.

One may envisage that several distribution holes open out into one and the same external rib.

LIST OF FIGURES

The invention and its different technical characteristics will be better understood on reading the following description accompanied by two Figures respectively representing;

FIG. 1, a partially sectioned frontal view of the grinding wheel according to the invention; and FIG. 2, a lateral half-view of the grinding wheel according to the invention.

DETAILED DESCRIPTION OF AN EMBODIMENT OF THE INVENTION

Figure 1:
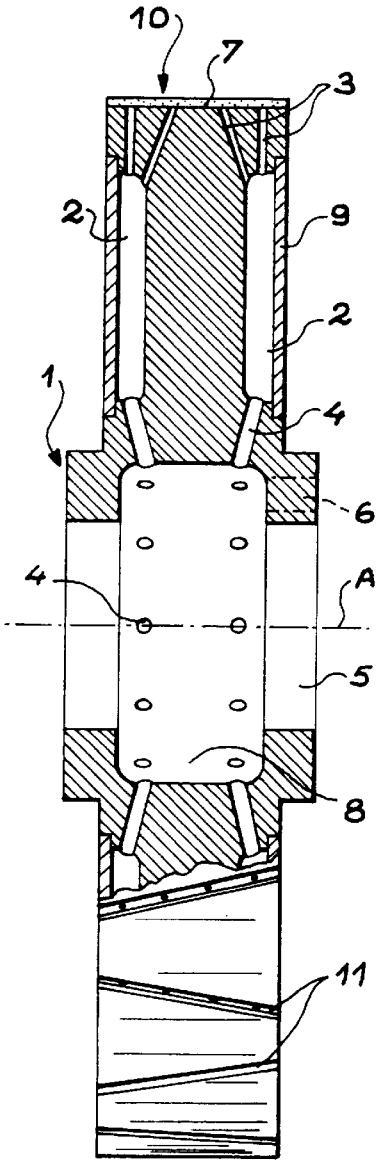

FIG. 1 shows all the elements of the grinding wheel according to the invention, that is to say principally the body 1 which forms the largest part of the wheel and the abrasive deposit 10 placed on the periphery of it. The peripheral surface 7 of the body 1 and the abrasive deposit 10 are represented as having a cylindrical form. This is only one of numerous forms that these two elements can take, as a function of the surface of the component to be machined.

The body 1 has a central void 5 by which it is fixed onto a shaft of a drive motor. It also has a central cavity 8 through which the cooling fluid, in this case water mixed with oil, comes in. A first solution consists of having this cooling fluid arrive through the central void 5, that is to say through the motor shaft. Another solution consists of having the fluid come in laterally through a lateral channel 6 shown in broken lines.

The body 1 has two lateral annular chambers 2 of small depth and connected by central holes 4 to the central void 5. These two lateral chambers 2, easily made by turning, are each closed by a sealing cover 9 fixed onto the body without any problem of concentric adjustment. Hence the cooling fluid, arriving through the central void 5 in the body 1 can go into the two lateral annular chambers 2.

Distribution holes 3 are provided in the body 1. They both open into the outside of the lateral annular chambers 2 and onto the peripheral surface 7 of the body 1, that is to say into the abrasive 10. On this embodiment example 4, the distribution holes 3 have, at the top of this FIG. 1, been shown opening out into the same sectional plane, in order to show that several distribution holes can end up on the same generator of the peripheral surface 7 of the body 1. This is one possibility, but it does not correspond with the embodiment shown in the lower part of FIG. 1 (not sectioned).

Figure 2:
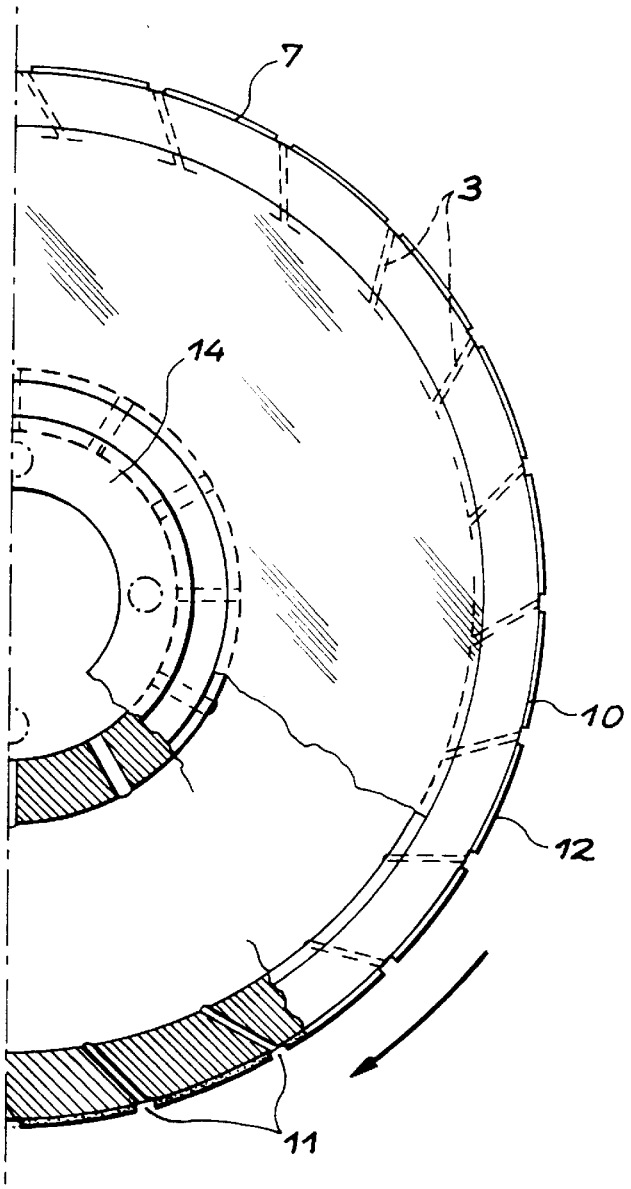

With reference to FIG. 2, it should be noted that the abrasive 10 can have external grooves 11 positioned opposite to the distribution holes 3. This allows the cooling fluid to be able to come out of the grinding wheel, the abrasive 10 not being porous. Hence the cooling fluid can reach all of the external surface 12 of the abrasive, that is to say, the cutting surface of the grinding wheel, in order to ensure its cooling and lubrication functions. On this same FIG. 2, it should be noted that these distribution holes 3 are slightly inclined so that the fluid comes out in the direction opposite to the direction of rotation represented by the arrow.

Returning to FIG. 1, it should be noted that the external grooves 11 are inclined with respect to the axis of rotation A of the grinding wheel. This allows better distribution of the cooling fluid over the whole width of the grinding wheel. The external grooves 11 are inclined alternately so that this fluid distribution should be as uniform as possible. In FIG. 2, a fixing flange 14 has been represented in order to symbolise the means of fixing the grinding wheel onto the motor shaft.

In the lower part of this FIG. 2, the grinding wheel has been cut away in order to show that the distribution holes can open out into the external grooves 11, in an inclined fashion with respect to the radius of the grinding wheel, that is to say, not perpendicular to the peripheral surface 7 of the body 1.

ADVANTAGES OF THE INVENTION

Quite clearly, the grinding wheel according to this invention allows one to do without lubrication and cooling nozzles and be free of the problems of accessibility to the cutting area and also positioning problems. The distribution of the cooling fluid through the grinding wheel permits a removal of the possibility of thermal shocks connected to the delicate distribution of this cooling fluid with a nozzle system, thereby limiting the risks of local overheating of the grinding wheel. Equally one avoids the consumption of extra power on the drive spindle due to the impact of cooling fluid on the grinding wheel.

The main advantage rests in the ease of creating the distribution circuit of the cooling liquid, that does not require precise machining or is not difficult to produce, such as very deep channels of small diameters.

Furthermore, the double arrival of cooling liquid on each side of the grinding wheel ensures cooling that is distributed in a uniform manner and which brings with it an optimum and constant quality of machining.

I claim:

1. A truing wheel comprising:

a body in the shape of a disc defining a central axis;

an abrasive deposit stuck to the peripheral surface of the body;

a cooling fluid supply conduit inside the body that comes out into the abrasive deposit by means of several distribution channels that open into a lateral annular chamber and into the abrasive deposit to lubricate the cutting area and cool the wheel, wherein the cooling fluid supply conduit includes two lateral annular chambers;

at least two central channels that open into a central chamber and into at least one of said lateral annular chambers;

two opposing sealing covers which define the lateral annular chambers.

2. A grinding wheel according to claim 1, wherein the distribution channels each open out into an external rib made in the abrasive deposit.

3. A grinding wheel according to claim 2, wherein the external ribs are inclined with respect to the central axis of the wheel.

4. A grinding wheel according to claim 3, wherein the ribs are alternately inclined.

5. A grinding wheel according to claim 2, wherein several distribution channels open out into one and the same external rib.

6. A grinding wheel according to claim 2, wherein the distribution channels open out into an external ribs in an inclined way.

* * * * *